US010487592B1

(12) United States Patent
Gupta et al.

(10) Patent No.: US 10,487,592 B1
(45) **Date of Patent: *Nov. 26, 2019**

(54) MULTI-DIRECTION TRAVERSABLE DRILLING RIG

(71) Applicant: NABORS DRILLING TECHNOLOGIES USA, INC., Houston, TX (US)

(72) Inventors: Ashish Gupta, Houston, TX (US); Enrique Abarca, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/970,608

(22) Filed: May 3, 2018

(51) Int. Cl.

| | |
|---|---|
| ***E21B 15/00*** | (2006.01) |
| ***E21B 33/06*** | (2006.01) |
| ***E21B 21/06*** | (2006.01) |
| ***E21B 19/15*** | (2006.01) |

(52) U.S. Cl.
CPC ..... *E21B 15/003* (2013.01); *E21B 19/155* (2013.01); *E21B 21/065* (2013.01); *E21B 33/06* (2013.01)

(58) Field of Classification Search
CPC ..... E21B 15/00; E21B 15/003; E21B 21/06; E21B 21/065; E21B 19/15; E21B 19/155; E04H 12/34
See application file for complete search history.

(56) References Cited

U.S. PATENT DOCUMENTS

| | | | | |
|---|---|---|---|---|
| 1,733,484 A | | 10/1929 | Davis | |
| 2,332,479 A | | 10/1943 | Woolslayer et al. | |
| 2,345,253 A | | 3/1944 | Funk | |
| 2,347,115 A | | 4/1944 | Lewis | |
| 2,594,847 A | | 4/1952 | Bates et al. | |
| 3,028,881 A | | 4/1962 | Koomey et al. | |
| 3,255,836 A | * | 6/1966 | Hoppmann | B62D 57/00 180/8.6 |
| 3,433,268 A | | 3/1969 | Greer | |
| 3,483,933 A | | 12/1969 | Dyer et al. | |
| 3,576,225 A | | 4/1971 | Chambers | |
| 3,676,984 A | | 7/1972 | Clark | |

(Continued)

FOREIGN PATENT DOCUMENTS

| | | |
|---|---|---|
| CA | 2755483 A1 | 11/2010 |
| CA | 2753417 A1 | 2/2011 |

(Continued)

OTHER PUBLICATIONS

Nabors 990 Proyecto LLANOS.WMV; https://www.youtube.com/watch?v=6BgfgWumRIU, Nabors Rig 990 Chichimene, Colombia; Youtube.com; Aug. 10, 2011 (231 pages).

(Continued)

*Primary Examiner* — Robert E Fuller
*Assistant Examiner* — Christopher J Sebesta
(74) *Attorney, Agent, or Firm* — Adolph Locklar

(57) ABSTRACT

A land-based drilling rig includes a plurality of columns. Each of the columns is a polyhedron having a square base or is cylindrical. The land-based drilling rig further includes a drill rig floor coupled to the plurality of columns. The land-based drilling rig also includes a mast, the mast mechanically coupled to the drill rig floor.

13 Claims, 14 Drawing Sheets

(56) References Cited

U.S. PATENT DOCUMENTS 3,716,149 A 2/1973 Scaggs
3,739,853 A 6/1973 Wales
3,802,137 A 4/1974 Armstrong
3,851,770 A 12/1974 Jenkins et al.
3,922,825 A 12/1975 Eddy et al.
3,937,334 A 2/1976 Bleyl et al.
3,942,593 A 3/1976 Reeve, Jr. et al.
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A * 5/1986 Woolslayer ..... E21B 15/00 52/116
4,744,710 A 5/1988 Reed
4,757,592 A 7/1988 Reed
4,759,414 A 7/1988 Willis
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A 7/1999 Reed
6,161,358 A 12/2000 Mochizuki et al.
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 12/2007 Barnes
7,308,953 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 10/2013 Wasterval
8,561,685 B2 10/2013 Rodgers
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 12/2014 Donnally et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 7/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 7/2017 Reddy et al.
9,739,098 B2 8/2017 Fox
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
2002/0001255 A1 1/2002 Flood et al.
2003/0172599 A1 9/2003 Frink
2008/0237170 A1 10/2008 Altman et al.
2009/0000218 A1 1/2009 Lee et al.
2009/0025980 A1 1/2009 Callander et al.
2009/0053013 A1 2/2009 Maltby
2009/0200856 A1 8/2009 Chehade et al.
2009/0272540 A1 11/2009 Rodgers
2010/0186960 A1 7/2010 Reitsma et al.
2011/0072737 A1 3/2011 Wasterval
2011/0174545 A1* 7/2011 Hartke ..... E21B 7/02 175/113
2012/0168179 A1* 7/2012 Havinga ..... E21B 19/22 166/384
2012/0304553 A1 12/2012 Konduc et al.
2013/0156538 A1* 6/2013 Smith ..... B62D 57/02 414/800
2013/0305632 A1 11/2013 Rivera, Sr. et al.
2014/0014417 A1* 1/2014 Smith ..... B62D 57/02 180/8.1
2014/0054097 A1 2/2014 Bryant
2015/0315861 A1* 11/2015 Zachariasen ..... E21B 19/22 166/385
2016/0186495 A1* 6/2016 Flusche ..... B62D 57/032 180/8.6
2016/0215592 A1 7/2016 Helms et al.
2016/0280524 A1 9/2016 Crisp et al.
2016/0298394 A1* 10/2016 Padira ..... E21B 15/003
2016/0369570 A1 12/2016 Reddy et al.
2017/0106925 A1 4/2017 Gupta et al.
2017/0292334 A1 10/2017 Reddy et al.
2017/0350153 A1 12/2017 Reddy et al.
2018/0016851 A1 1/2018 Reddy et al.
2018/0030788 A1 2/2018 Reddy et al.
2018/0119496 A1 5/2018 Reddy et al.
2018/0128056 A1 5/2018 Gupta et al.

(56) References Cited

U.S. PATENT DOCUMENTS

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

MULTI-DIRECTION TRAVERSABLE DRILLING RIG

CROSS-REFERENCE TO RELATED APPLICATIONS

None.

FIELD OF THE DISCLOSURE

The present disclosure relates generally to drilling rigs, and specifically to drilling rig structures for land drilling in the petroleum exploration and production industry.

BACKGROUND OF THE DISCLOSURE

Land-based drilling rigs may be configured to move from location to location to drill multiple wells within s a wellsite. It is often desirable to move the land-based drilling rig across an already drilled well within the wellsite for which there is a well-head in place. Further, mast placement on land-based drilling rigs may have an effect on drilling activity. For example, depending on mast placement on the drilling rig, an existing well head may interfere with the location of land-situated equipment such as, for example, existing well heads and may also interfere with raising and lowering of equipment needed for operations.

SUMMARY

The present disclosure provides for a land based drill rig. The land-based drilling rig includes a plurality of columns. Each of the columns is a polyhedron having a square base or is cylindrical. The land-based drilling rig further includes a drill rig floor coupled to the plurality of columns. The land-based drilling rig also includes a mast, the mast mechanically coupled to the drill rig floor.

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
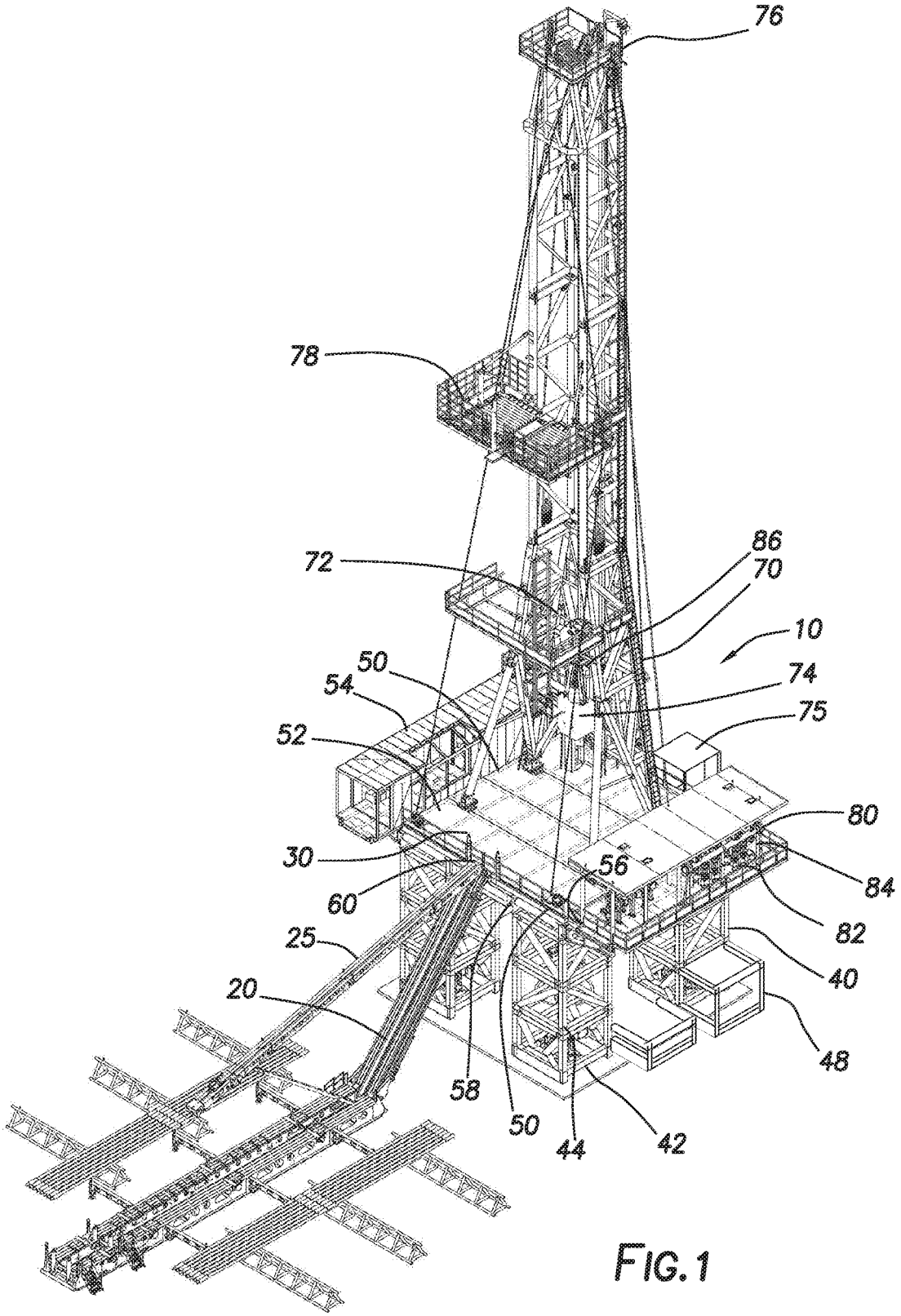
FIG. 1 is a perspective view of a land-based drilling rig consistent with at least one embodiment of the present disclosure.

FIG. 1 is a perspective view of land-based drilling rig 10 consistent with at least one embodiment of the present disclosure. Land-based drilling rig 10 may include drill rig floor 30 supported by columns 40. In some embodiments, drill rig floor 30 is fixedly attached to columns 40, such as by pinning or welding. Drill rig floor 30 includes driller's side 52, on which driller's cabin 54 is positioned or cantilevered from, and off-driller's side 56, which is the side of drill rig floor opposite driller's cabin 54. Drill rig floor 30 is further defined by V-door side 58, having V-door or opening 60 positioned thereon. V-door side 58 of drill rig floor 30 is adjacent slide 25 and catwalk 20. V-door 60 may be positioned between at least two of columns 40 on drill rig floor 30.

Figure 3:
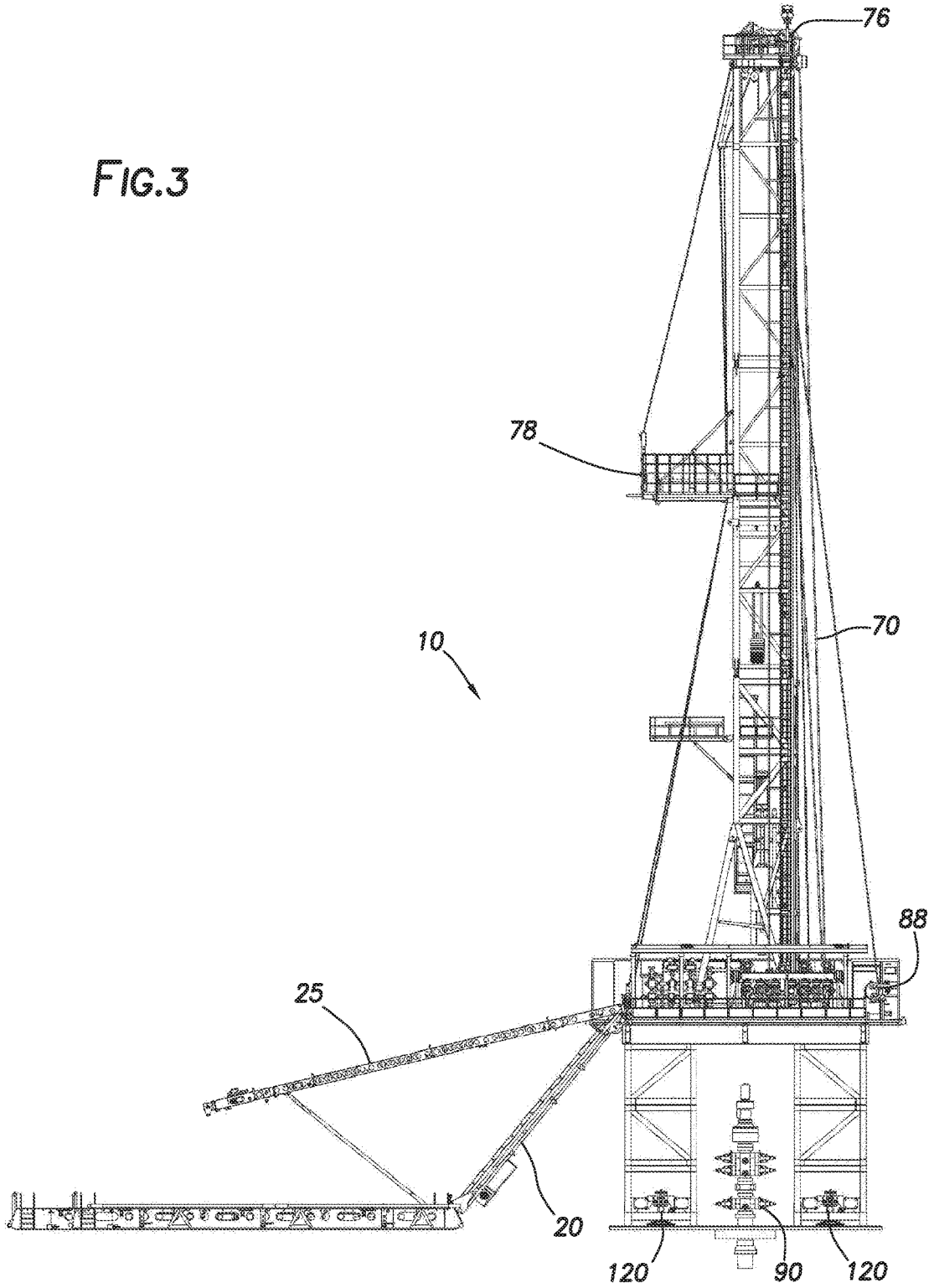
FIG. 3 is a side elevation from the off-driller's side of a land-based drilling rig consistent with at least one embodiment of the present disclosure.
Figure 4:
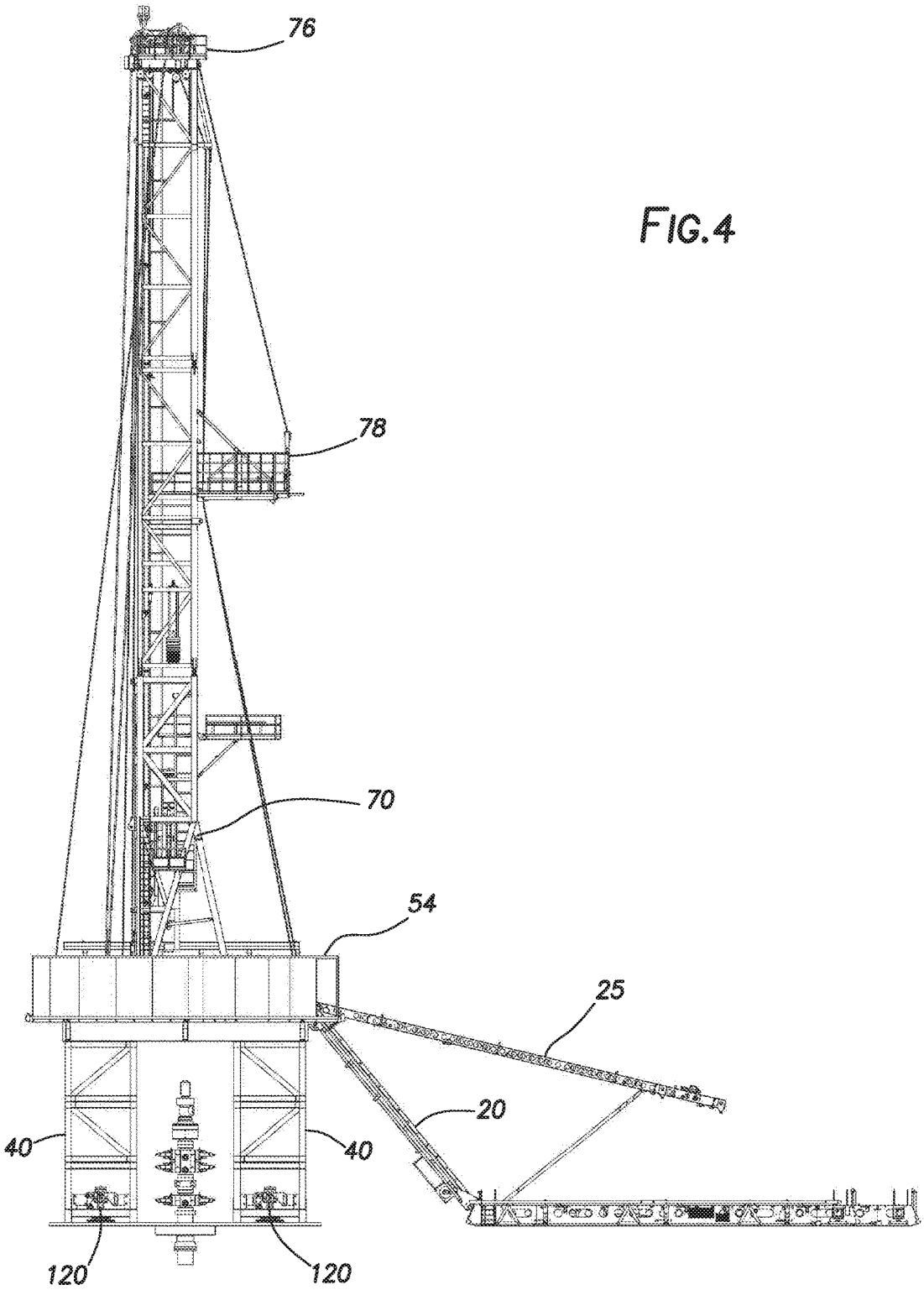
FIG. 4 is a side elevation from the driller's side of a land-based drilling rig consistent with at least one embodiment of the present disclosure.
Figure 5:
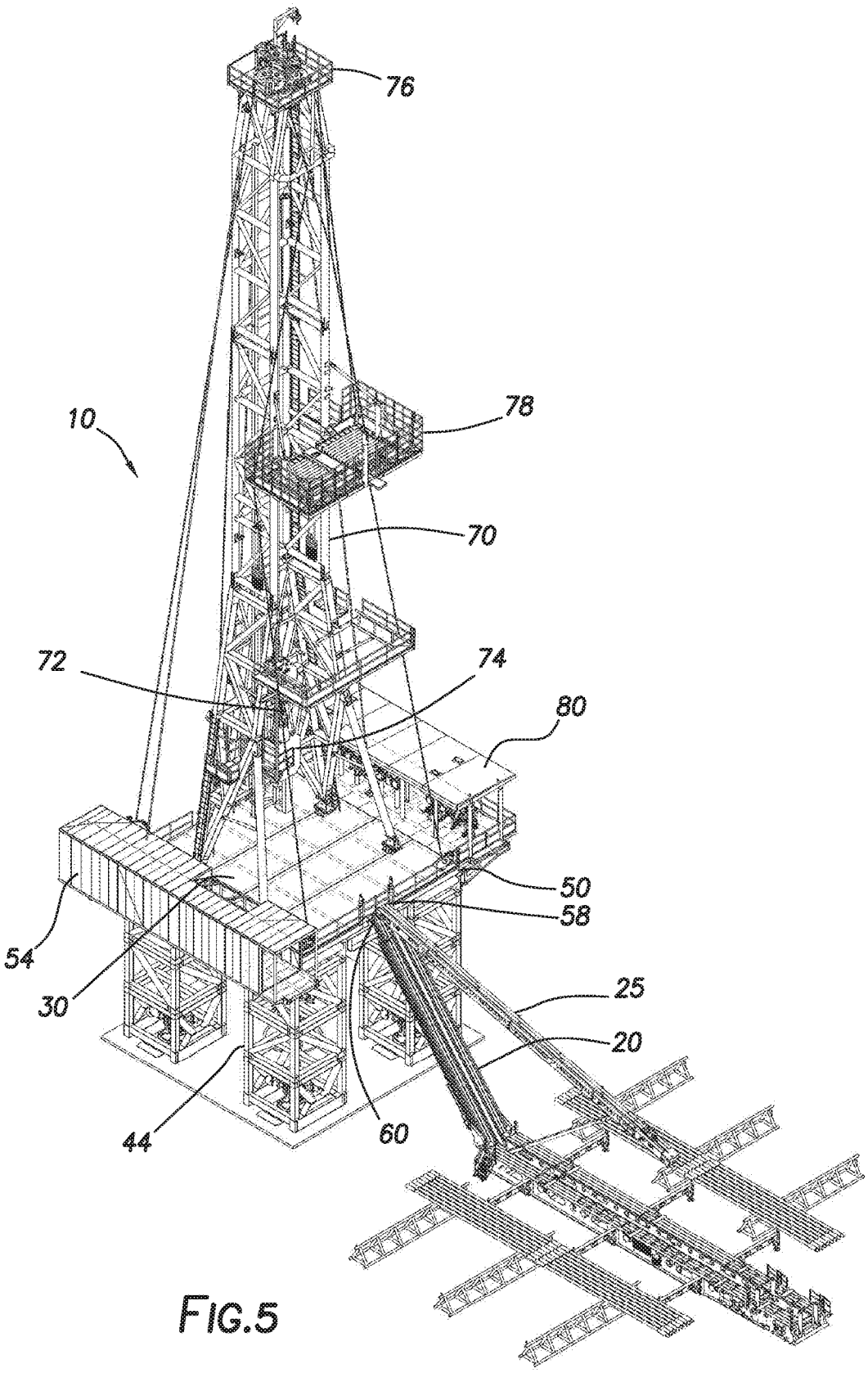
FIG. 5 is a perspective view of a land-based drilling rig consistent with at least one embodiment of the present disclosure.

Choke house 80 may be positioned on or cantilevered to drill rig floor 30. In certain embodiments, choke house 80 may be positioned on choke house skid 82. Choke house 80 may include choke manifold 84. In certain embodiments, as shown in FIG. 3, drawworks 88 may be positioned on drill rig floor 30, a drawworks skid, or choke house skid 82.

Columns 40 may be polyhedrons having square base 42 and rectangular sides 44. In certain embodiments, the height of columns 40, as measured from square base 42 to drill rig floor 30 may be longer than the width of columns 40 as measured along square base 42. In other embodiments, the height and width of columns 40 may be the same. In other embodiments, columns 40 may be cylindrical. Columns 40 may be formed from structural supports, such as struts. While shown as having four columns 40, land-based drilling rig 10 may have any number of columns 40.

Figure 6:
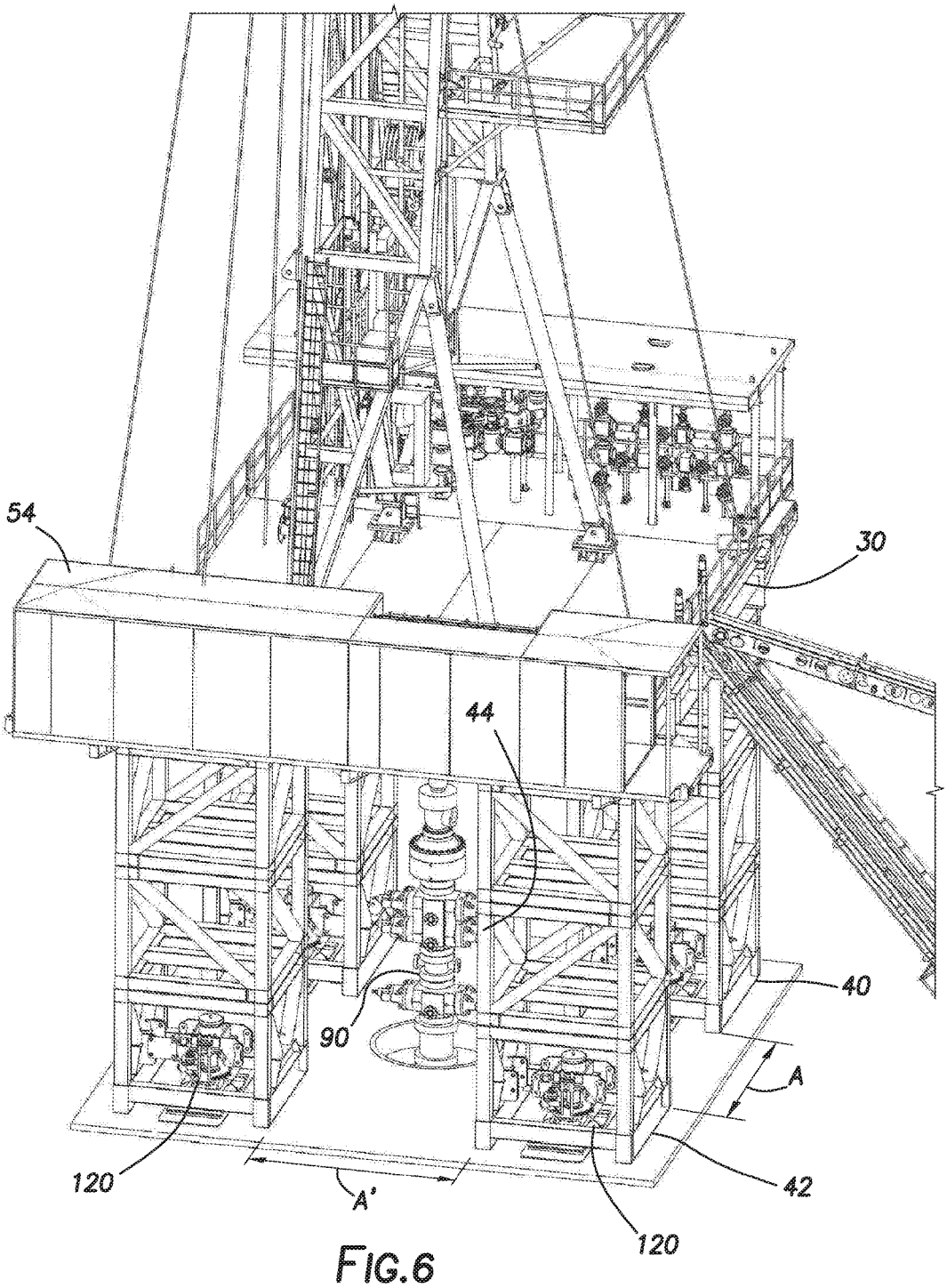
FIG. 6 is a perspective detail of a land-based drilling rig consistent with at least one embodiment of the present disclosure.
Figure 7:
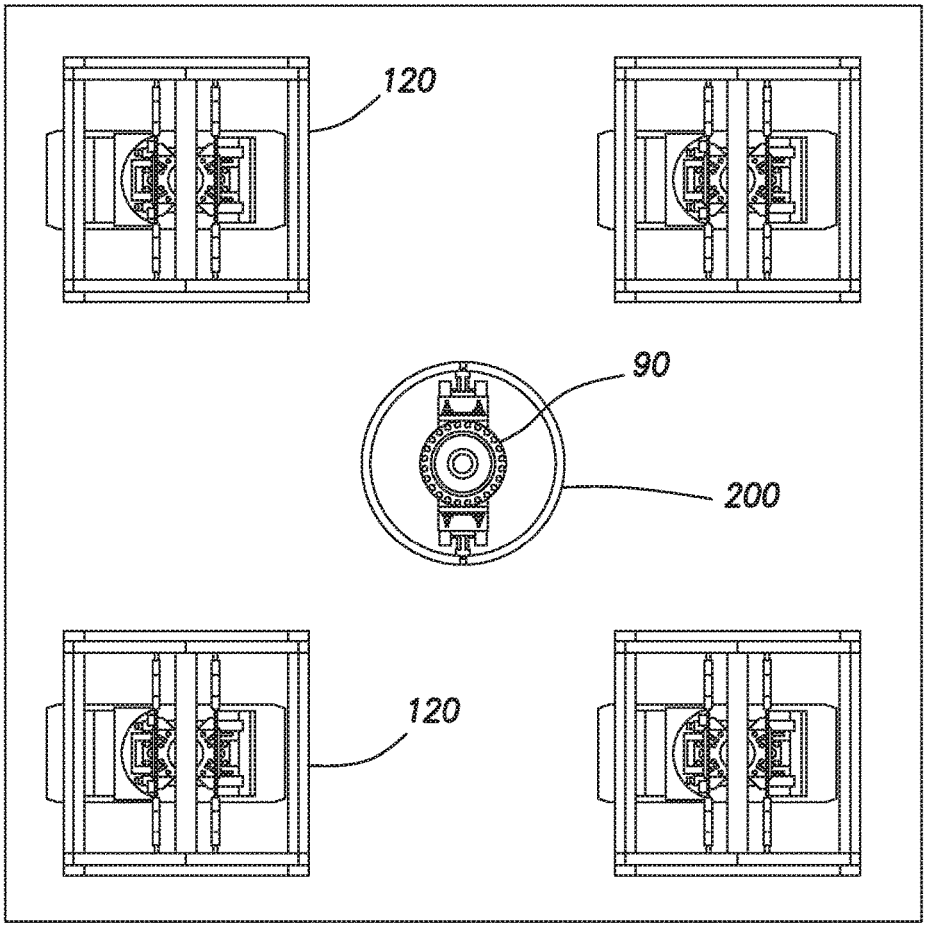
FIG. 7 is a cross section of the walkers of a land-based drilling rig consistent with at least one embodiment of the present disclosure.

In the embodiments shown in the Figures, columns 40 may be positioned at or near edges 50 of drill rig floor 30, although such a position is non-limiting. In the embodiments shown in the Figures, as exemplified by FIG. 6, columns 40 are positioned such that distance A, A' (wherein distance A is the distance between columns positioned on the V-door side of the land-based drilling rig and A' is the distance between columns 40 positioned on the driller's side or off-drillers side) between any two columns 40 is sufficient to allow wellhead 90 to pass between columns 40 when land-based drilling rig 10 is moved within the wellsite. Distances A, A' may be the same or different.

Mast 70 may be fixedly or pivotably coupled to drill rig floor 30. Mast 70 may include mast V-door side 72, which faces drilling rig V-door side 58. Mast V-door side 72 is an open side of mast 70. Equipment positioned within mast 70 may include travelling block 86 and top drive 74. Crown block 76 may be positioned on top of mast 70 and pipe rack 78 mechanically attached to mast 70.

Figure 2:
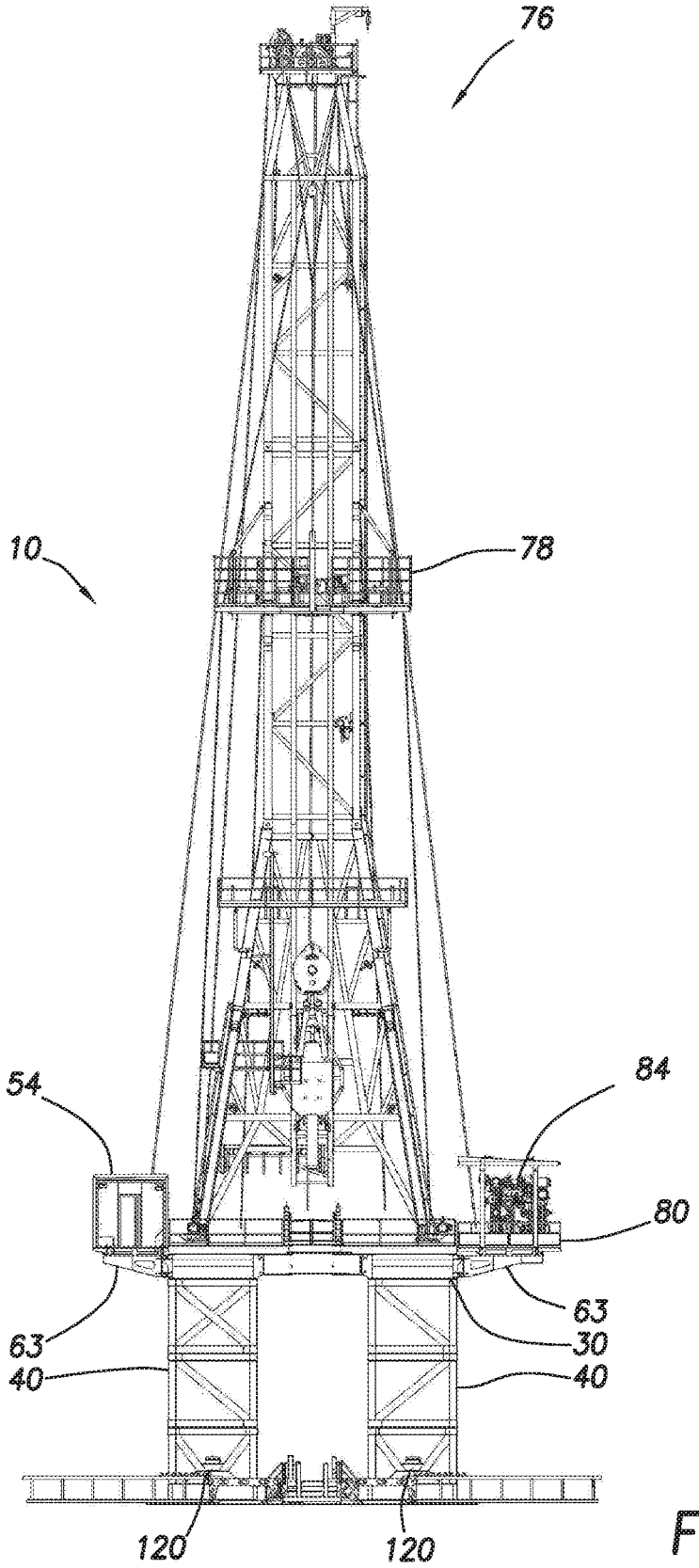
FIG. 2 is a front elevation of a land-based drilling rig consistent with at least one embodiment of the present disclosure.

In some embodiments, drill rig floor 30 may include one or more upper equipment support cantilevers 63. As depicted in FIG. 2, each upper equipment support cantilever 63 may be hingedly or fixedly coupled to drill rig floor 30 or at least one of columns 40. In some embodiments, upper equipment support cantilevers 63 may support one or more pieces of drilling rig equipment mechanically coupled to upper support cantilevers 63, including one or more of, for example and without limitation, mud process equipment, choke manifold 84, accumulator, mud gas separators, process tanks, trip tanks, drill line spoolers, HPU's, VFD, and driller's cabin 54. In other embodiments, mud gas separator skid 75 may mechanically couple to drill rig floor 30 and extend vertically downward from rig floor 30 to the ground level. In some embodiments, accumulator skid 48 may mechanically couple to columns 40. In some embodiments, additional equipment including, for example and without limitation, mud tanks, trip tanks, process tanks, mud process equipment, compressors, variable frequency drives, or drill line spoolers, may be coupled to drilling rig 10. In some embodiments, equipment coupled to drill rig 10, including, for example and without limitation, driller's cabin 54, choke house 80, mud gas separator skid 75, and accumulator skid 48, may travel with drilling rig 10 as it moves through the wellsite.

In some embodiments, as depicted in FIGS. 3, 4, 6, and 7, drilling rig 10 may include one or more hydraulic walkers 120. Hydraulic walkers 120 may be positioned at a lower end of one or more columns 40. In some embodiments, hydraulic walkers 120 may be hydraulically actuatable to move or walk land-based drilling rig 10 to a different location in the wellsite. In some embodiments, hydraulic walkers 120 may be operable to move or walk drilling rig 10 in any direction. In some embodiments, equipment positioned on upper support cantilevers 63 may be moved with drilling rig 10 as it is moved or walked.

Figure 8A:
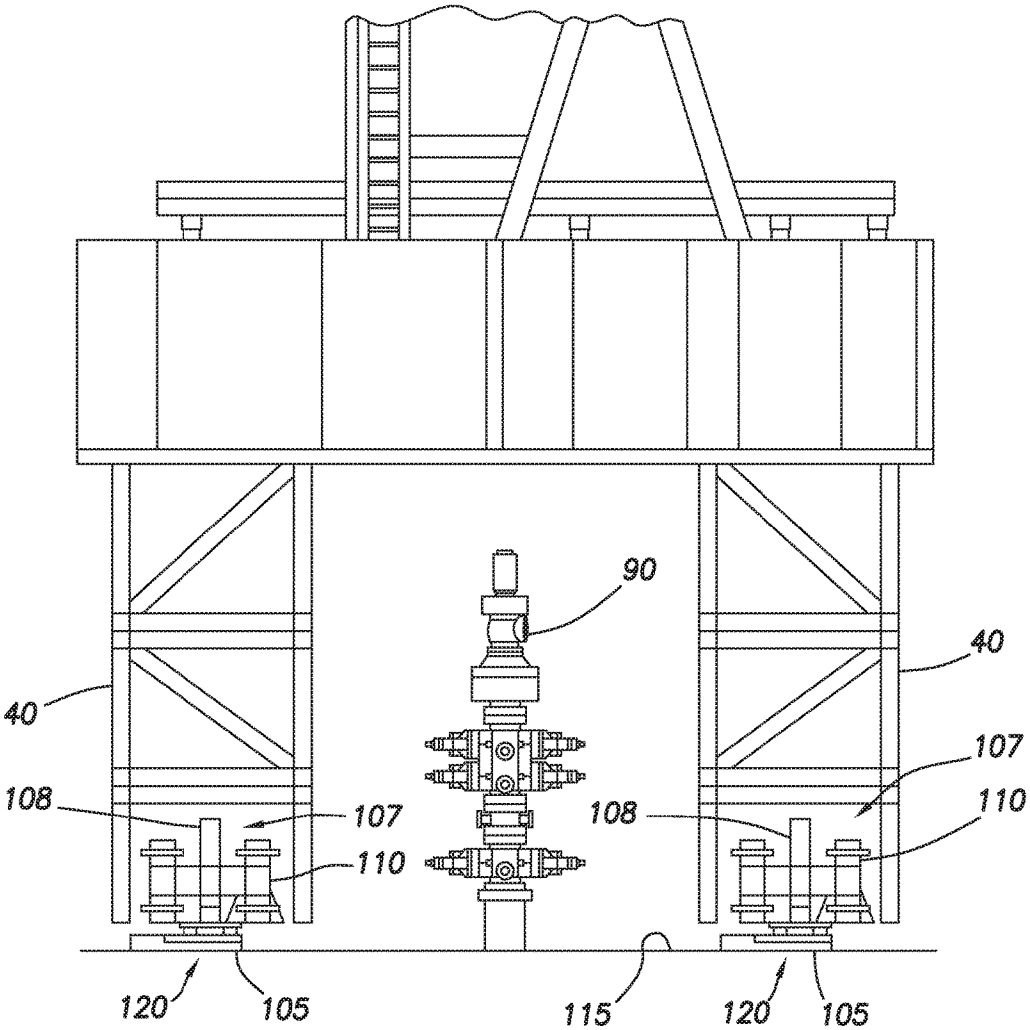
FIGS. 8A-8D are side schematic views of a walking land-based drilling rig consistent with at least one embodiment of the present disclosure.
Figure 8B:
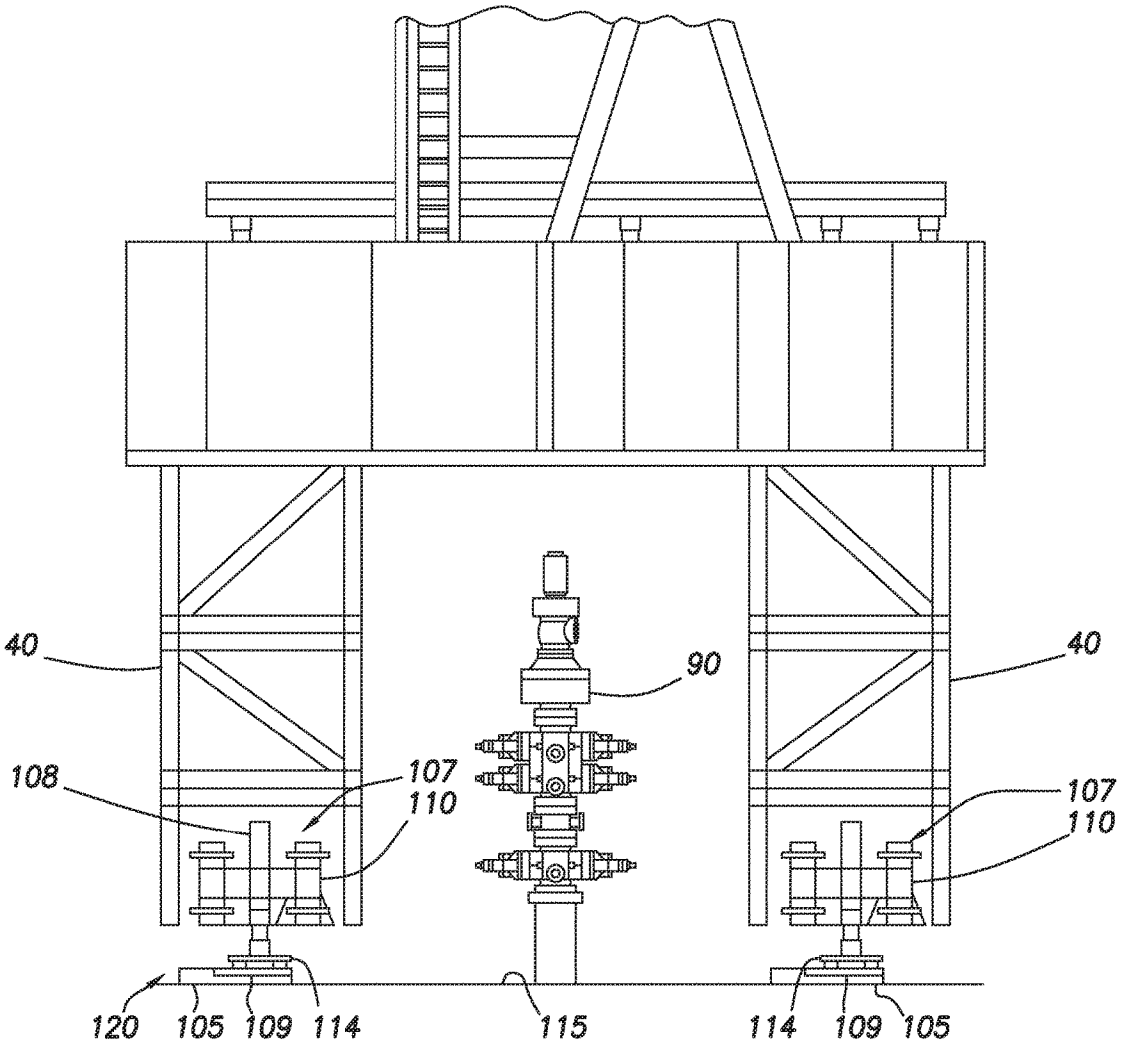

A non-limiting embodiment of a hydraulic walker for use with drilling rig 10 is shown in FIGS. 8A-8D. Hydraulic walkers 120 may include walking foot 105 and hydraulic lift assembly 107 as depicted in FIG. 8A. Walking foot 105 may be a pad or any other structure configured to support the weight of drilling rig 10 and associated equipment during a walking operation as discussed herein below. Hydraulic lift assembly 107 may include one or more hydraulic cylinders 108 positioned to move hydraulic walker 120 between a retracted position, as depicted in FIG. 8A, and an extended position, as depicted in FIG. 8B. Hydraulic lift assembly 107 may be mechanically coupled to column 40 by mounting structure 110. Mounting structure 110 may include any mechanical fasteners, plates, or other adapters to couple between hydraulic lift assembly 107 and column 40. In some embodiments, mounting structure 110 may be an outrigger structure. In a walking operation, depicted in FIGS. 8A-8D, hydraulic walkers 120 may be positionable in a retracted position as shown in FIG. 8A. In the retracted position, column 40 may be in contact with the ground 115, allowing the weight of land-based drilling rig 10 to be supported by column 40. When hydraulic walker 120 is in the extended position, as depicted in FIG. 8B, walking foot 105 may support column 40 above the ground.

Figure 8C:
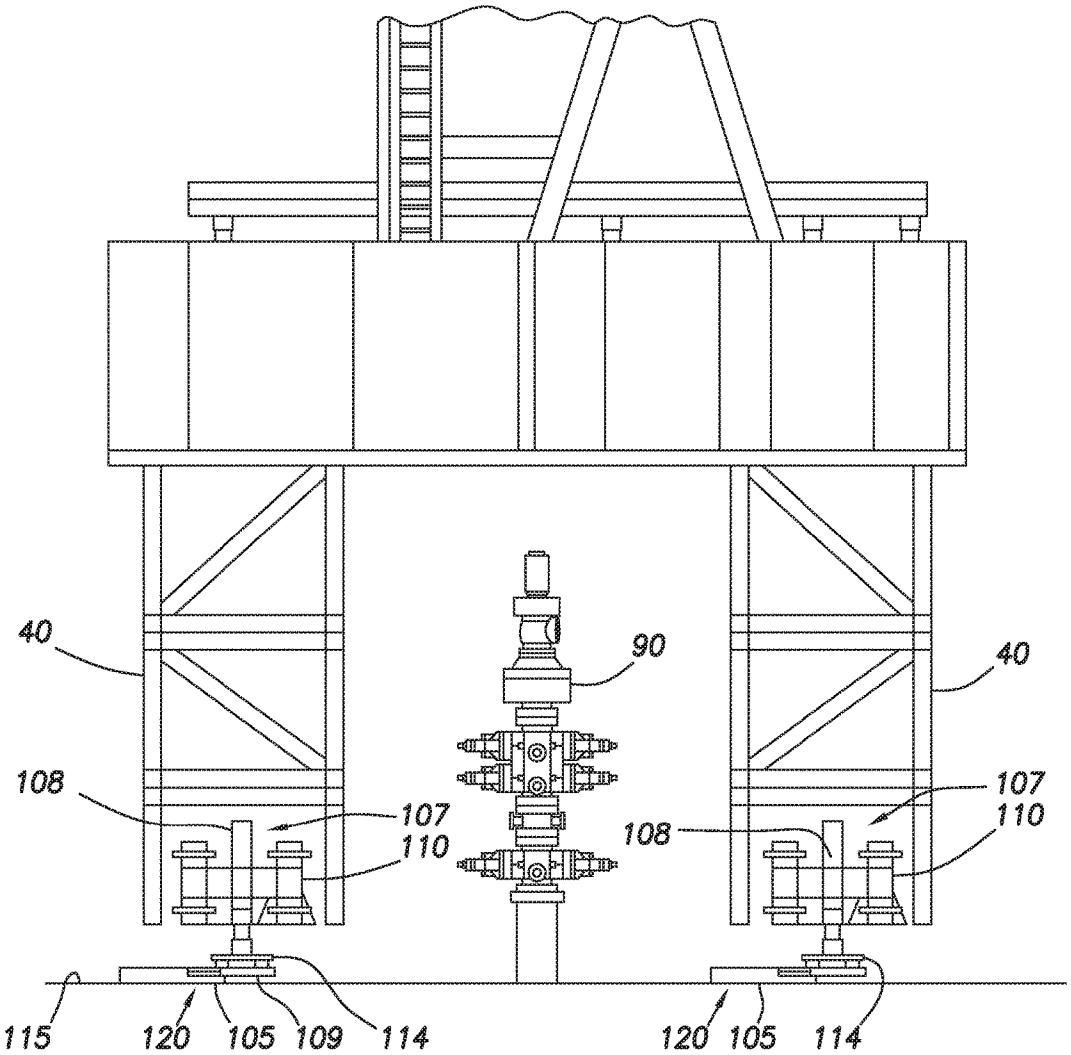
Figure 8D:
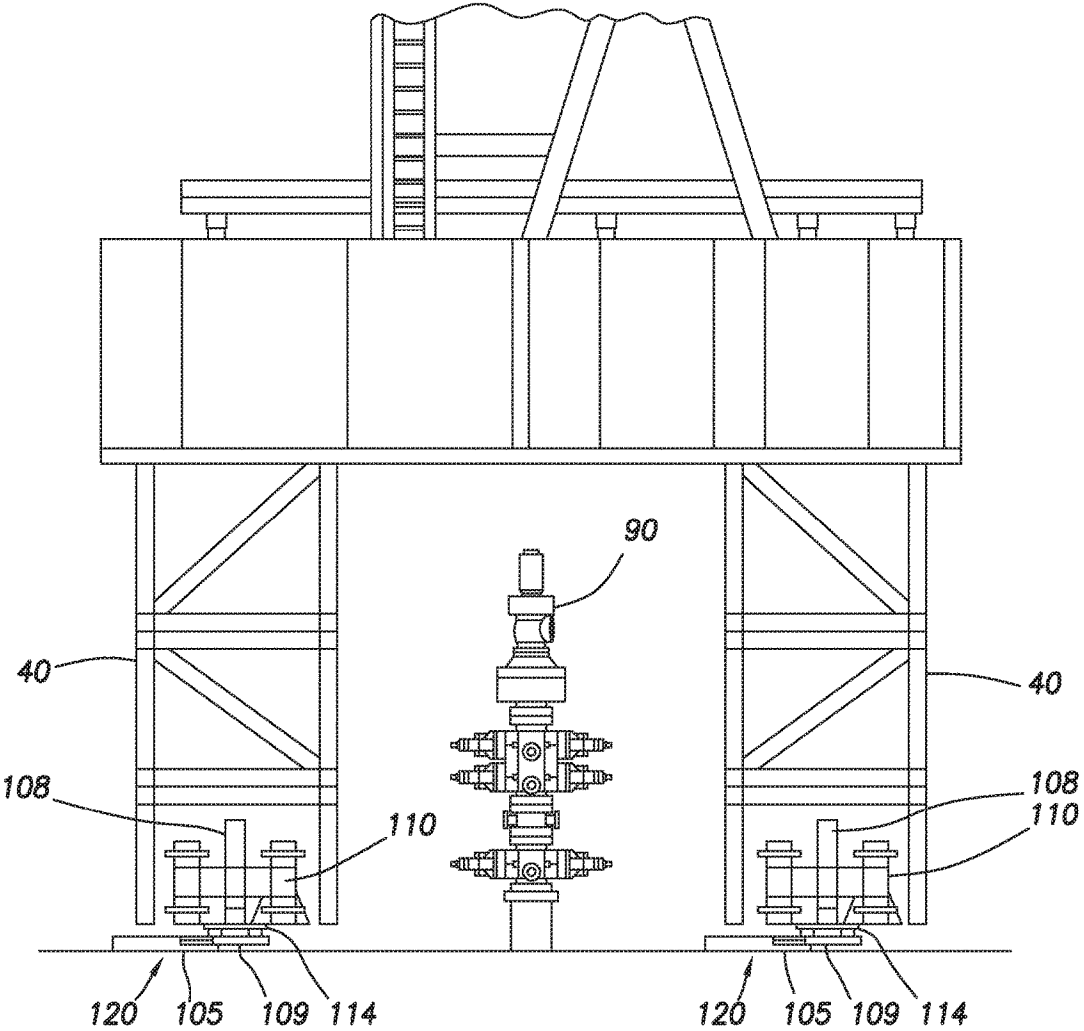

Once hydraulic walker 120 is in the extended position, sliding actuator 109 may be actuated to move walking foot 105 laterally relative to hydraulic lift assembly 107 from a first position to a second position as depicted in FIG. 8C. In some embodiments, one or more bearing surfaces, linear bearings, ball bearings, or roller bearings may be positioned between walking foot 105 and hydraulic lift assembly 107 as understood in the art to, for example and without limitation, bear the weight of drilling rig 10 and any equipment thereon during a walking operation. Sliding actuator 109 may include one or more hydraulic cylinders or other linear actuators 114 used to move walking foot 105 horizontally relative to drilling rig 10. For example, when walking foot 105 is in contact with the ground as depicted in FIG. 8B, the movement of walking foot 105 by sliding actuator 109 may cause drilling rig 10 to move along ground 115 to a position as shown in FIG. 8C. Hydraulic lift assembly 107 may retract, lifting walking foot 105 from ground 115 and allowing drilling rig 10 to contact the ground 115 as depicted in FIG. 8D. Sliding actuator 109 may be reactuated with walking foot 105 off ground 115 to cause walking foot 105 to be returned to its original position, resetting hydraulic walkers 120 to the first position as depicted in FIG. 8A.

Figure 9A:
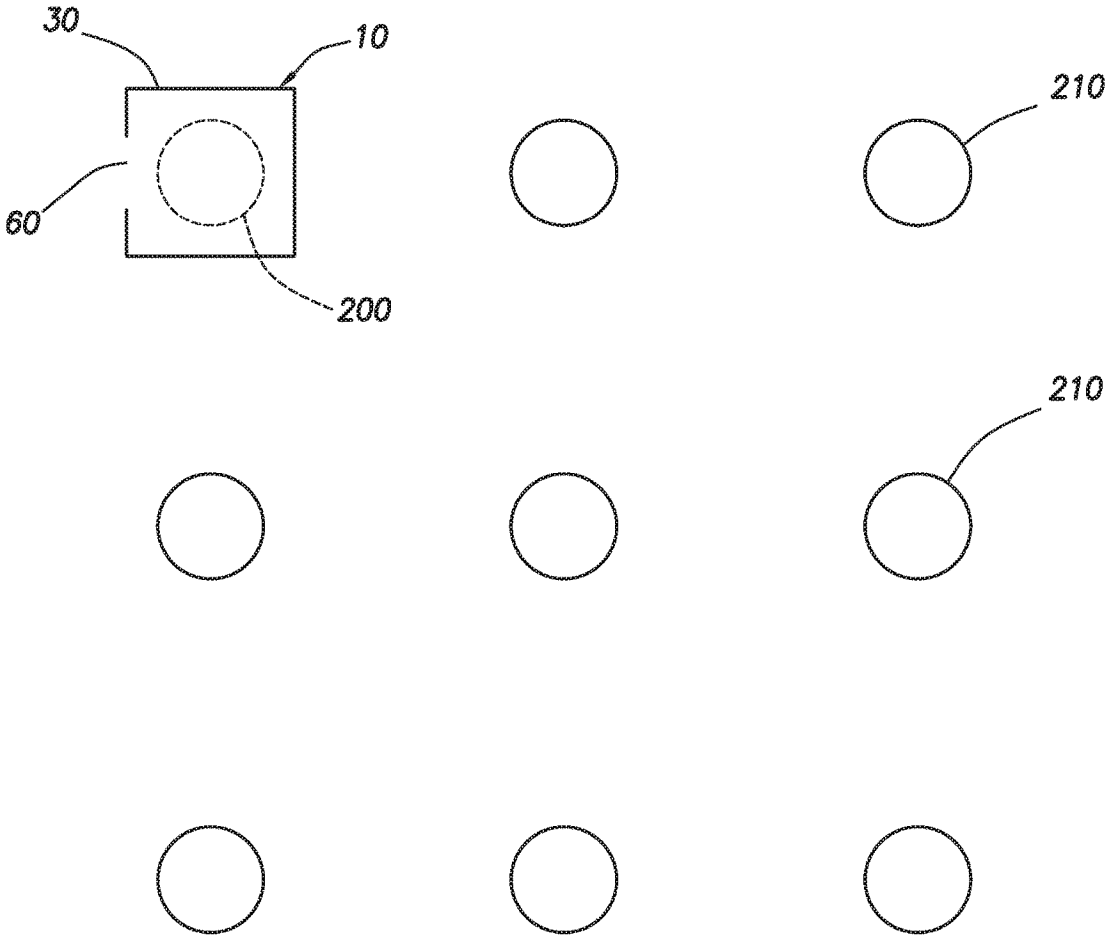
FIGS. 9A-9C are overhead diagrammatic overhead views of a land-based drilling positioned over different well centers consistent with at least one embodiment of the present disclosure.
Figure 9B:
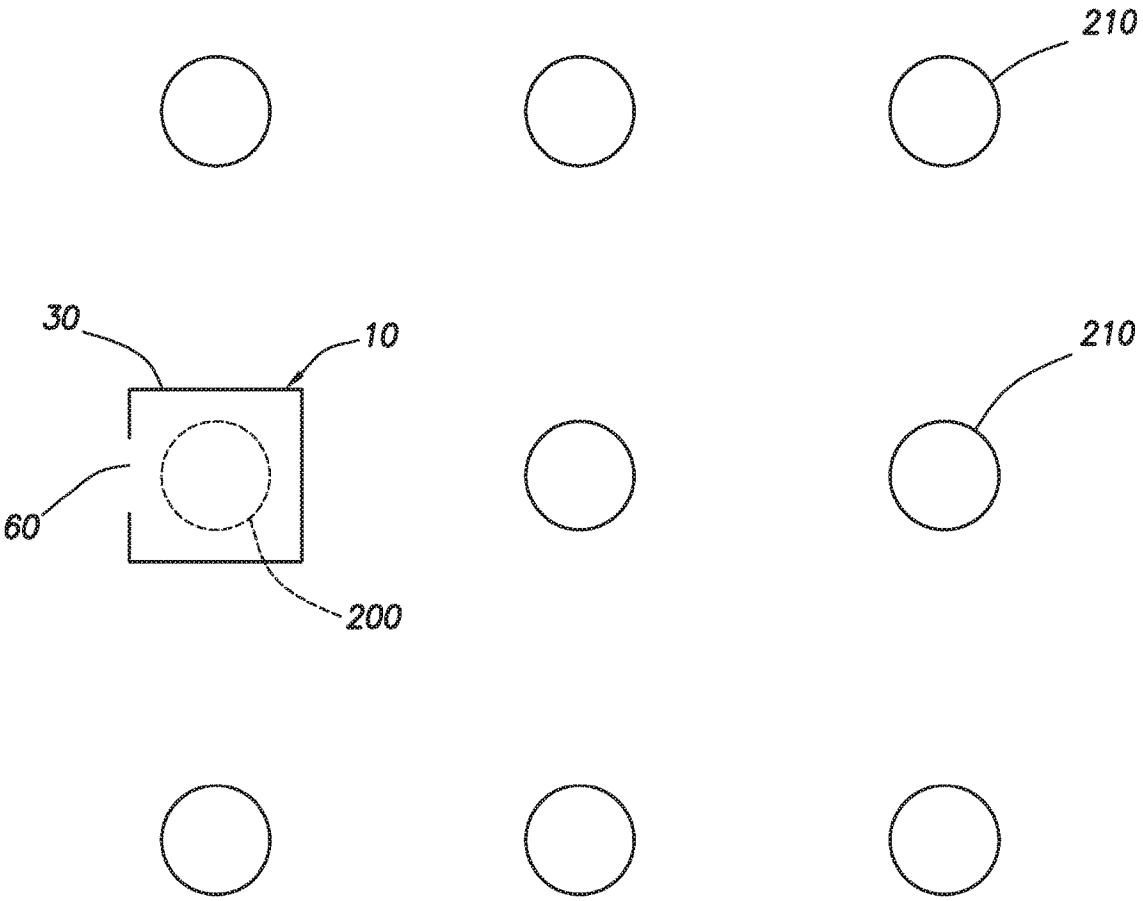
Figure 9C:
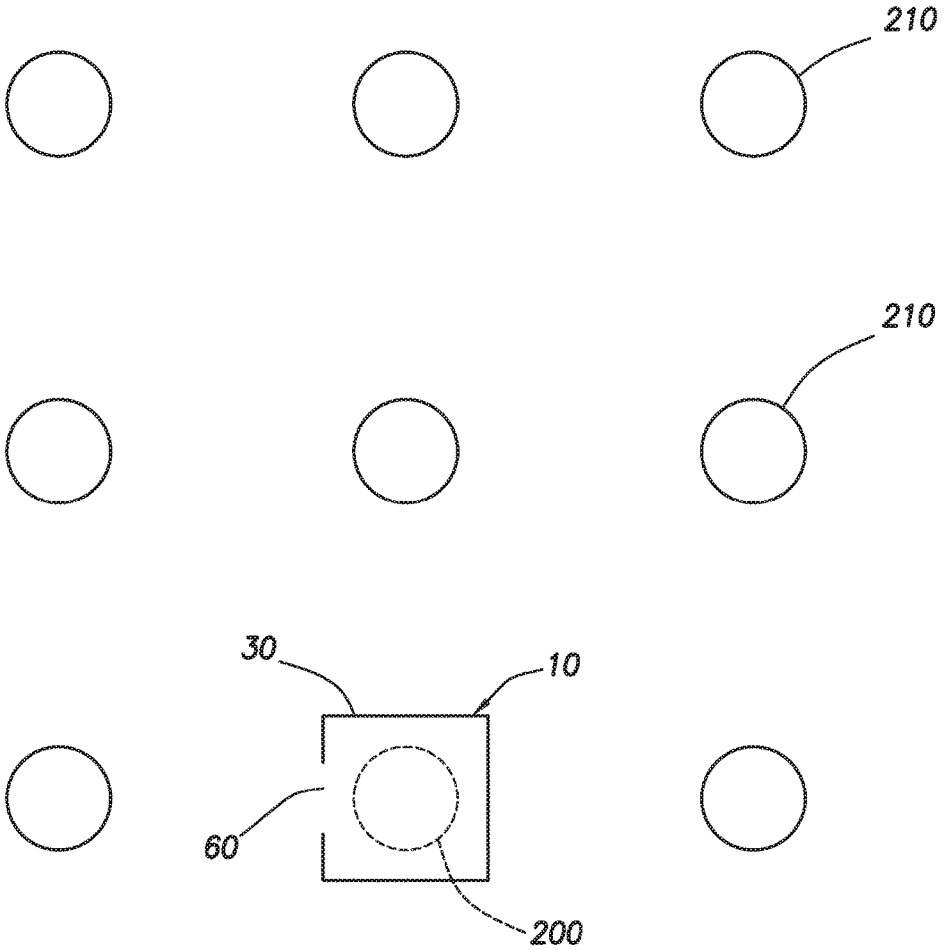

FIGS. 9A-9C are schematic overhead views of placement of land-based drilling rig 10 over various wellcenters 200 in wellsite 210. As shown in FIGS. 9A-9C, because distances A and A' are larger than the diameter of wellhead 90, land-based drilling rig 10 may be moved within wellsite 210 without disassembly and assembly of land-based drilling rig 10. Further, as hydraulic walkers 120 may be moved in any direction, V-door side 58 of drill rig floor 30 may be rotated so as to avoid interference with other wellheads 90 within wellsite 210.

One having ordinary skill in the art with the benefit of this disclosure will understand that the specific configurations depicted in the figures may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land-based drilling rig comprising:

a plurality of columns, the plurality of columns being either polyhedrons having a square base or generally cylindrical, wherein each of the plurality of columns includes an upper end and a lower end, and wherein the lower end of each column includes a hydraulic walker having a retracted position and an extended position;

a drill rig floor, the drill rig floor having an upper surface and a lower surface, wherein the upper end of each column is pinned or welded directly to the lower surface of the drill rig floor, and wherein the retracted position of each hydraulic walker is beneath the drill rig floor;

at least one equipment support cantilever, wherein the equipment support cantilever is hingedly or fixedly coupled to at least one of the drill rig floor or a column, and wherein the equipment support cantilever is adapted to support one or more pieces of drilling rig equipment mechanically coupled thereto; and a mast, the mast mechanically coupled to the upper surface of the drill rig floor;

wherein the weight of the mast and drill rig floor is supported by the columns regardless of whether the hydraulic walkers are in the retracted position or the extended position; and wherein the distance between two adjacent columns is A and the distance between two other adjacent columns is A', wherein A and A' are each greater than the diameter of a wellhead and wherein the land-based drilling rig is adapted to be moved away from a wellsite such that the wellhead passes between any pairing of columns forming distances A or A'.

2. The land-based drilling rig of claim 1, wherein the drill rig floor includes a V-door, a side of the drill rig floor having the V-door defining a V-door side of the drill rig floor, and wherein the V-door is positioned between at least two of the plurality of columns.

3. The land-based drilling rig of claim 1 further comprising a driller's cabin, the driller's cabin positioned on the upper surface of the drill rig floor or cantilevered from a driller's side of the drill rig floor.

4. The land-based drilling rig of claim 3 further comprising a driller's cabin, the driller's cabin positioned on the equipment support cantilever.

5. The land-based drilling rig of claim 1 further comprising a choke manifold, the choke manifold positioned on an off-driller's side of the upper surface of the drill rig floor.

6. The land-based drilling rig of claim 1, wherein each column has a square base and rectangular sides.

7. The land-based drilling rig of claim 6 having four columns, wherein each of the columns is positioned at or near edges of the drill rig floor.

8. The land-based drilling rig of claim 1, further comprising one or more of drill line spooler, hydraulic power unit, compressor, variable frequency drive, mud process equipment, choke manifold, accumulator, mud gas separator, process tank, or trip tank positioned on the upper surface of the drill rig floor or cantilevered from the drill rig floor.

9. The land-based drilling rig of claim 1, wherein the mast is fixedly coupled or pivotably coupled to the upper surface of the drill rig floor.

10. The land-based drilling rig of claim 1, wherein each hydraulic walker is hydraulically actuable to move or walk the land-based drilling rig to a different location.

11. The land-based drilling rig of claim 10 wherein the hydraulic walker comprises:

a walking foot;

a hydraulic lift assembly including a hydraulic cylinder coupled to the walking foot; and a sliding actuator including one or more hydraulic cylinders coupled to the walking foot.

12. The land-based drilling rig of claim 11, wherein at least a portion of the hydraulic walkers is rotatable relative to the column.

13. The land-based drilling rig of claim 11, wherein the hydraulic walkers are adapted to move the land-based drilling rig by:

extending the hydraulic walker to the ground;

moving the hydraulic walker from laterally relative to the hydraulic lift assembly from a first position to a second position; and retracting the hydraulic lift assembly, such that the walking foot is lifted from the ground.

* * * * *